United States Patent [19]

Voegeli

[11] 4,449,643

[45] May 22, 1984

[54] KNOCK-DOWN VENDING RACK

[75] Inventor: Ronald C. Voegeli, Venice, Fla.

[73] Assignee: Leco Engineering & Machine, Inc., Venice, Fla.

[21] Appl. No.: 285,441

[22] Filed: Jul. 21, 1981

[51] Int. Cl.[3] ..... B65H 1/04

[52] U.S. Cl. ..... 221/226; 312/257 SK

[58] Field of Search ..... 312/257 SM, 264, 257 SK; 221/226, 227, 232; 194/1 G, 59, 65

[56] References Cited

U.S. PATENT DOCUMENTS

| | | | |
|---|---|---|---|
| 4,126,364 | 11/1978 | Reilly | 312/257 SK |
| 4,174,047 | 11/1979 | Owens | 221/227 X |
| 4,331,261 | 5/1982 | Brown | 221/232 |

*Primary Examiner*—Stanley H. Tollberg

*Attorney, Agent, or Firm*—Burns, Doane, Swecker & Mathis

[57] ABSTRACT

A newspaper vending rack is designed to be transported and stored in a disassembled format. The rack includes four side wall members that are accommodated within channels or grooves formed in each of the top and bottom members of the rack. The top and bottom members are held together, to thereby clamp the side wall members in place, by a pair of guide rods that support an elevator shelf and are pinned to the top member and bolted to the bottom member. One of the side wall members includes a frame supporting a pivotable door that provides access to the interior of the enclosure formed by the rack.

18 Claims, 5 Drawing Figures

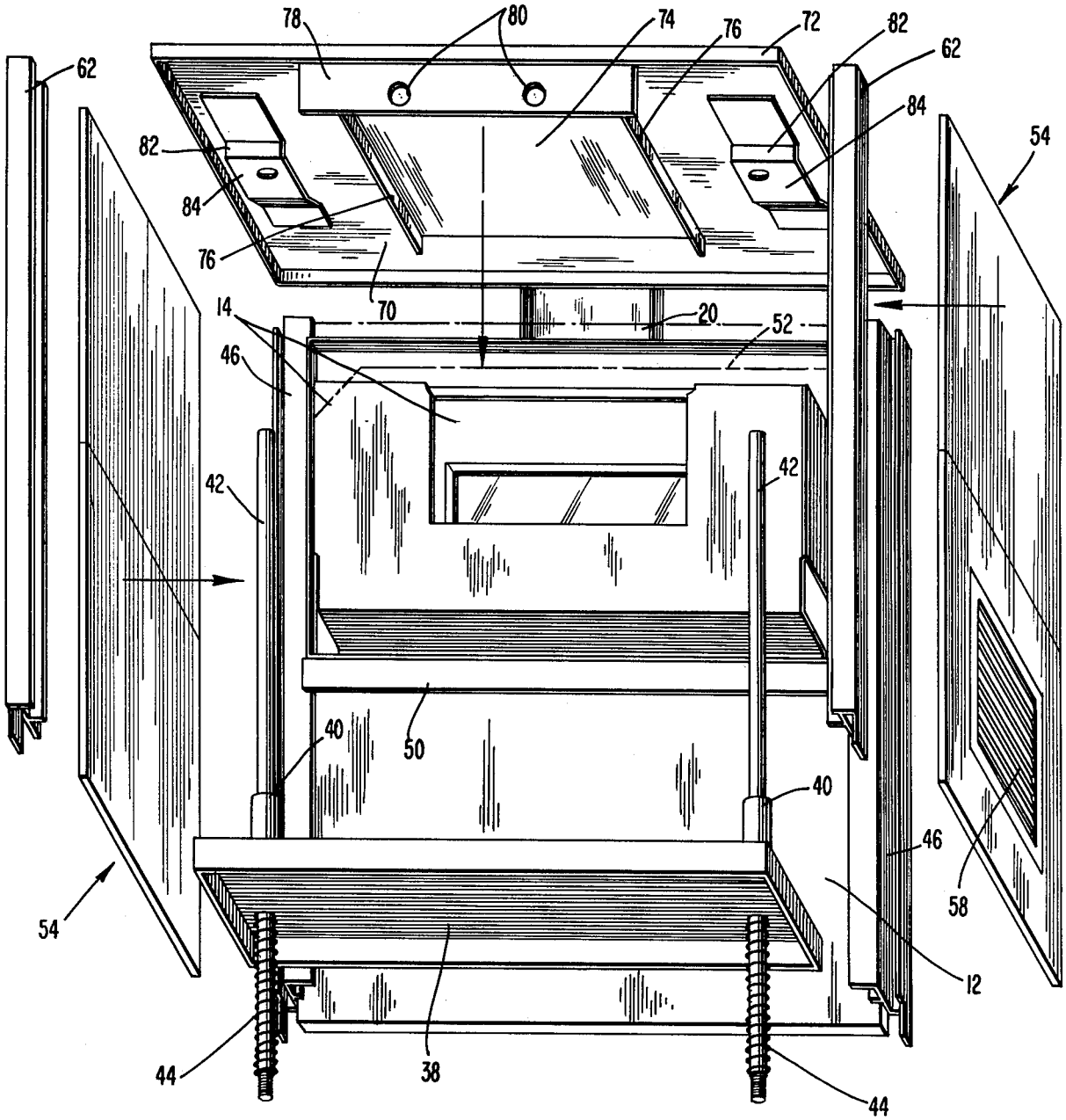
FIG. 3
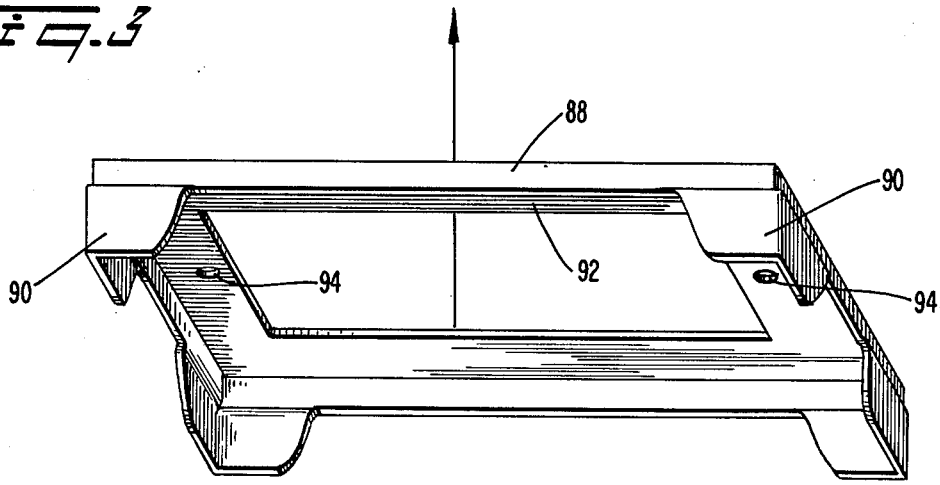

26
36
24
70
86
20
72
78
82
84
76
52
14
102
56
42
18
V
V
50
46
40
16
38
12
46
98
44
16
100
96
92
88
90

KNOCK-DOWN VENDING RACK

BACKGROUND OF THE INVENTION

The present invention relates to article vending and display racks, and in particular to newspaper vending racks that are easily transportable and provide a solid structure that can readily withstand extreme environmental conditions, as well as abuse.

The type of vending rack to which the present invention applies is disclosed in general in U.S. Pat. No. 3,760,923 with particular reference to a coin operated newspaper vending machine. In the past, newspaper racks of this type have been completely assembled at the place of manufacture and shipped in ready-to-use form, with the possible exception of, perhaps, the coin operated latch mechanism, which can be installed at the final destination. Typically, newspaper racks of this type stand approximately 3 to 3½ feet high and have lateral dimensions of 1½ to 2 feet. Moreover, coin operated racks of this type commonly have the coin operated mechanism housed within a coin receiving box mounted on the top of the rack. The presence of the coin receiving box, which is installed on the rack at the place of manufacture, inhibits easy stacking of the vending racks. Consequently, due to the volume of space occupied by each rack and the difficulties associated with stacking them, a standard shipment, i.e., truckload, of racks would number approximately only 250 racks.

Recently, the components of newspaper vending racks of this type are comprised primarily of plastic and aluminum, which results in each individual rack being of relatively light weight. For example, a standard shipment of 350 racks might weigh only 15,000 pounds. This weight is substantially less than the total weight capacity of most modern shipping vehicles, and consequently a truck carrying a load of racks would not be utilized most efficiently in terms of total transportable weight.

In addition to transportation considerations, fully assembled newspaper vending racks could require substantial storage space once they have reached the final destination. For example, a newspaper publisher may desire to keep a supply of racks on hand as replacements for racks that could become damaged or destroyed, for example due to vandalism. In such a case, the publisher would be required to rent storage area for the extra supply of racks, since a newspaper printing plant normally does not have a substantial amount of storage space available.

Newspaper vending racks of the type disclosed in the above-mentioned U.S. patent have met with a great deal of success, and it is the general object of the present invention to provide a novel improvement for these types of racks which will overcome the previously noted limitations regarding storage and transportation. More particularly, it is an object of the present invention to provide a novel vending rack whose components can be easily assembled at the final utilization point for the racks with a minimal requirement for tools and man hours, thereby permitting the rack to be shipped in a knocked-down, i.e. disassembled, state. The ability to transport, and store, the rack in a disassembled form provides substantial savings in terms of space requirements, and hence cost.

Furthermore, the ability to ship the rack in less than a fully assembled state can provide additional significant cost savings for foreign importers of the rack.

More specifically, when a newspaper vending rack is shipped to a foreign country in a fully assembled form, the importer is required to pay an import tax. If the rack is capable of being shipped in a disassembled form, with final assembly taking place within the country of final destination, the import tax imposed on the rack will be reduced from that encountered with fully assembled racks.

Furthermore, the handling of the racks is greatly simplified when they are in a disassembled state. Prior art racks that are fully assembled at the manufacturing plant are required to be handled individually. However, a knock-down type of rack can be packaged in its disassembled form and a plurality of packaged racks can be easily accommodated on a standard pallet, so that a number of racks can be easily handled with a single fork lift mechanism. The ability to transport the racks with a fork lift substantially reduces the number of man hours required in their handling.

The manner in which the present invention achieves these, as well as other, objects and advantages will be more fully appreciated from a perusal of the following detailed description of a preferred embodiment thereof, with reference to the accompanying drawings.

BRIEF DESCRIPTION OF THE DRAWINGS

FIG. 3 is an exploded, perspective view from the rear of a knock-down vending rack incorporating the novel concepts of the present invention, with the rear panel of the rack not being shown to clarify the illustration of the components;

DETAILED DESCRIPTION

The invention is described hereinafter with reference to its preferred embodiment as a coin controlled newspaper vending rack. However, it will be appreciated by those of ordinary skill in the art that the invention is not limited thereto. For example, a rack constructed in accordance with the principles of the present invention may be utilized for vending articles other than newspapers. Furthermore, it is not necessary that access to the interior of the rack be limited to the deposit of the proper amount of coins, and the rack can be freely opened for dispensing and display purposes, for example for the distribution of free tabloids or the like. Accordingly, the following description is not intended to be limitative of the varied applications for the present invention.

Figure 2:
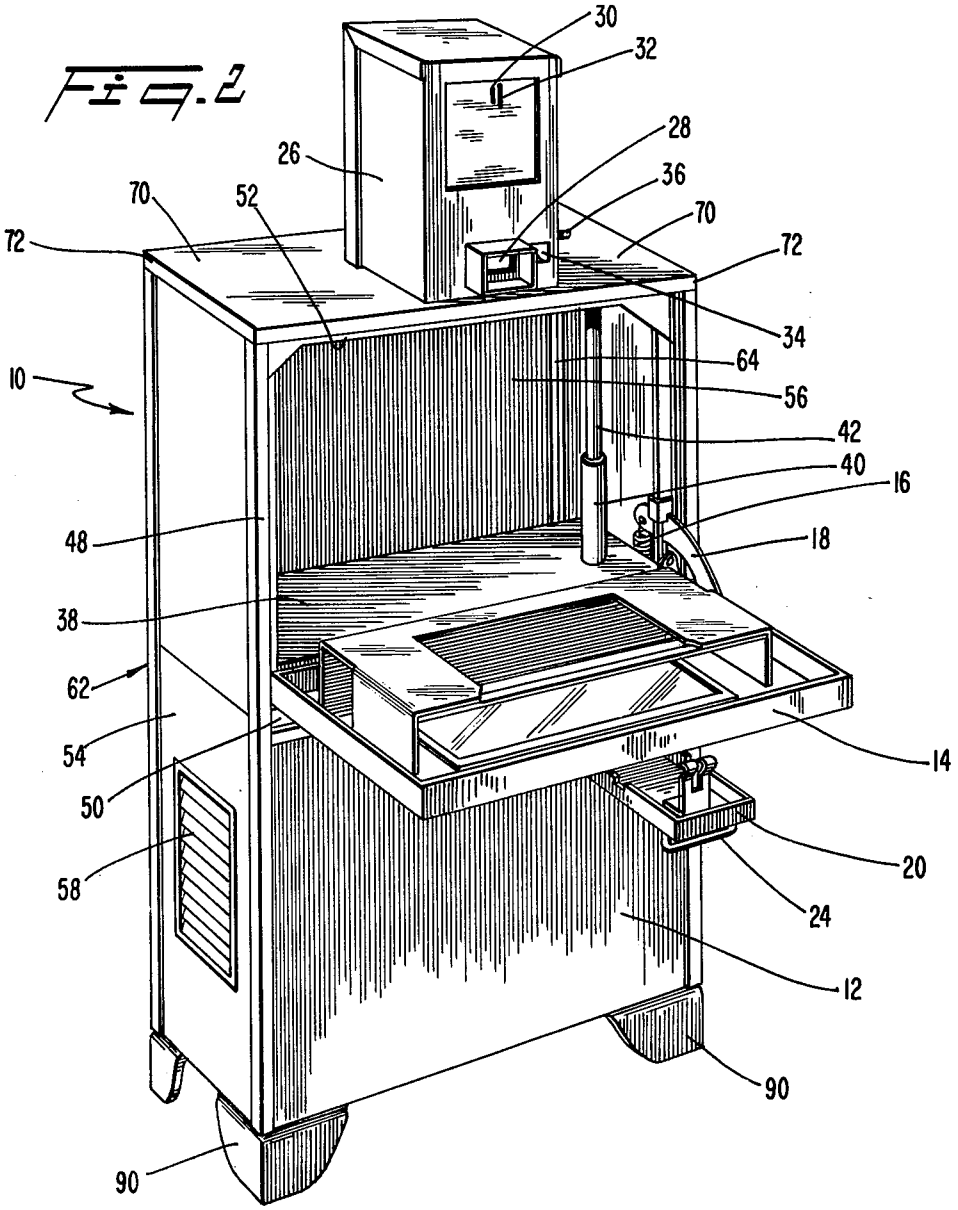
FIG. 2 is a generally perspective view similar to FIG. 1, but with the door open to more clearly illustrate the support of the newspapers in the vending rack.
Figure 1:
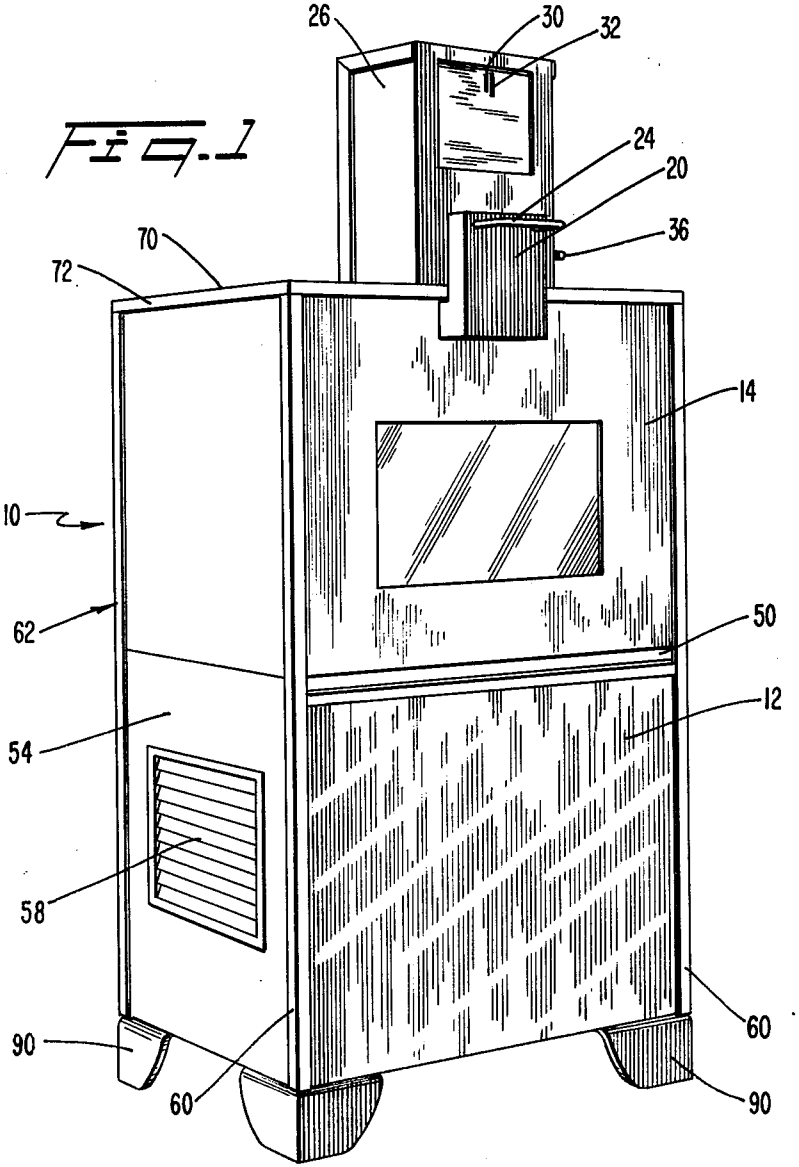
FIG. 1 is a generally perspective view of a newspaper vending rack, with the door of the vending rack closed.

Referring to FIGS. 1 and 2 of the drawings, a newspaper vending machine includes a cabinet 10 having a lower portion closed by a front panel 12 and an upper portion closed by a pivotally mounted door 14 normally biased to the closed position illustrated in FIG. 1 by a spring 16 connected between an arm 18 on the door and a frame member of the cabinet. The door 14 is preferably constructed of metal for inherent support, while the front panel 12 can be made of any suitable sheet material, such as a transparent or colored plastic, for example.

The door 14 has an upper central plate 20 on the inside of which a spring-biased latch member 22 is pivotally mounted. A handle 24 is connected to the outside of the plate 20. A closed coin box 26 is mounted on top of the cabinet 10 and includes a slot 28 which receives the latch 22. A pair of coin deposit slots 30, 32 are provided in the coin box 26. A coin operated mechanism is housed within the coin box 26 and functions to retain the latch member 22 in its normal spring biased latching position to hold the door 14 closed until the proper coin or combination of coins is deposited in the slots 30, 32. The coin box 26 includes a coin return chute 34 and an opening for a manual coin return push lever 36. Further details of the construction of a coin box that can be used on a vending rack incorporating the principles of the present invention are disclosed in U.S. Pat. Nos. 3,945,228 and 4,135,375. An example of a coin operated latch mechanism that can be incorporated in a coin box to control the opening of the door 14 is disclosed in U.S. Pat. No. 3,760,923.

As best illustrated in FIG. 1, newspapers are supported generally horizontally within the cabinet 10 on a spring loaded, elevator type shelf 38 which operates to maintain the papers at the height of the access to the interior of the cabinet provided by the door 14. The shelf 38 includes a pair of upwardly extending tubular sleeves 40 which are slidingly supported on a pair of vertical guide rods 42 that extend between the top and the bottom of the cabinet 10. The upper ends of the tubular sleeves 40 are preferably curved inwardly to closely surround the rods 42. An elongated coil spring 44 surrounds each rod 42 and has its lower end engaging the bottom of the cabinet 10 and its upper end telescopically received within a tubular sleeve 40 and abutting against the inwardly curved end of the sleeve.

As the top paper or papers are removed from a stack on the shelf 38, the weight supported on the shelf will decrease and the shelf will be raised by the upward force exerted by the compressed springs 52 to thereby maintain the uppermost paper at the height of the access opening provided by the door at all times. The tubular sleeves 40 are particularly beneficial in permitting the shelf 38 to be fully loaded and lowered completely to the bottom of the cabinet. In such a position, the compressed springs 44 are wholly received within the sleeves 40 so that no space is lost between the bottom of the shelf and the bottom floor of the cabinet. Accordingly, a relatively great number of newspapers can be accommodated in the rack.

As discussed previously, racks of this type were conventionally fully assembled at the time they left the manufacturing plant. In one known construction of such a rack, the side and rear walls of the cabinet were made with a single, shaped sheet of metal, or more recently, molded plastic. The front panel, the bottom and top of the rack, and the pivotable door with its supporting structure, were fixedly attached to the single piece wall construction, for example by rivets, welding, or bolts. However, in accordance with the present invention, the vending rack includes a number of separable elements having mating interconnections that facilitate easy assembly of the rack at the place of final destination with a minimal requirement for fastening elements and tools.

Figure 4:
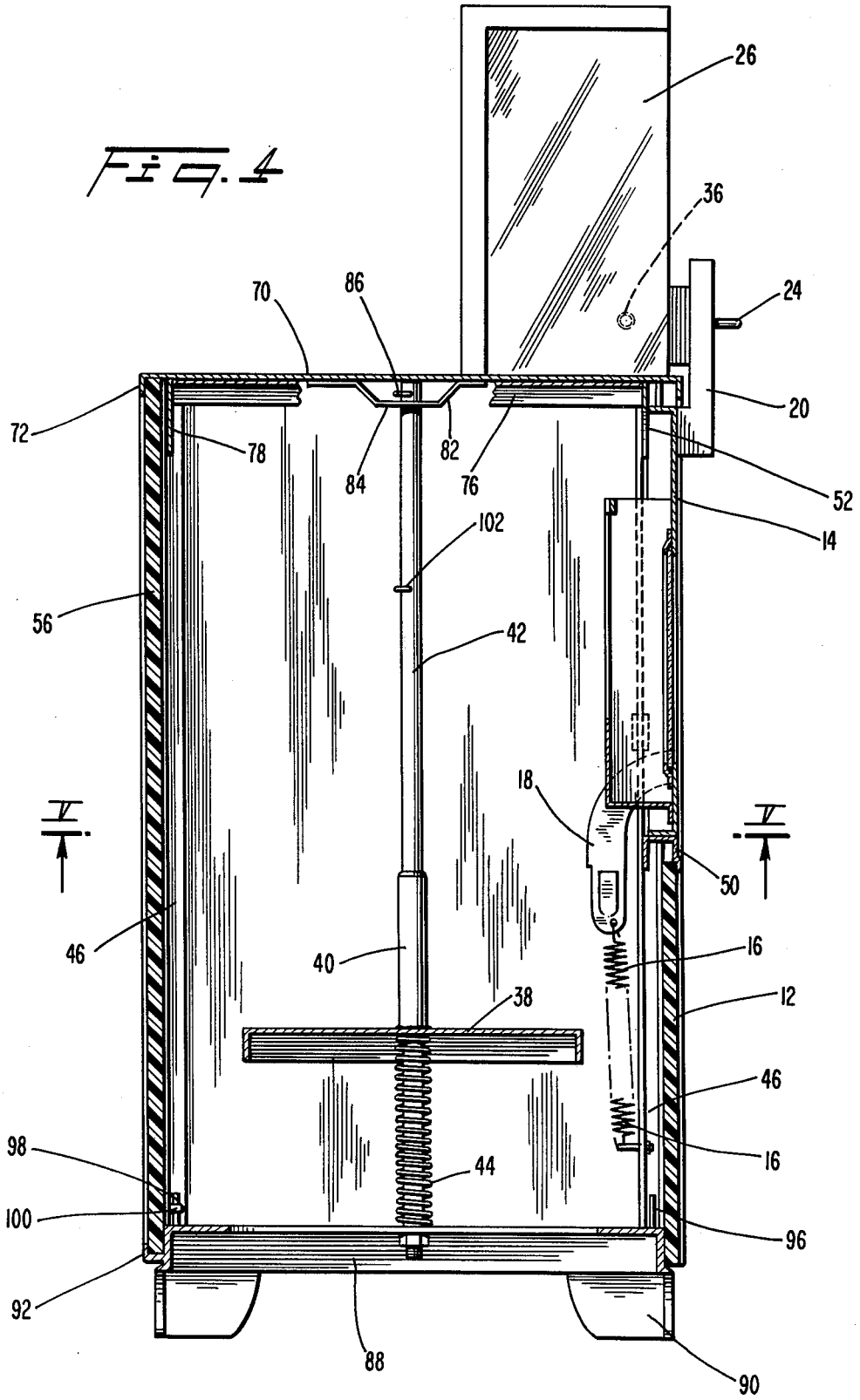
FIG. 4 is a cross-sectional side view of the vending rack shown in FIG. 3, when fully assembled.
Figure 5:
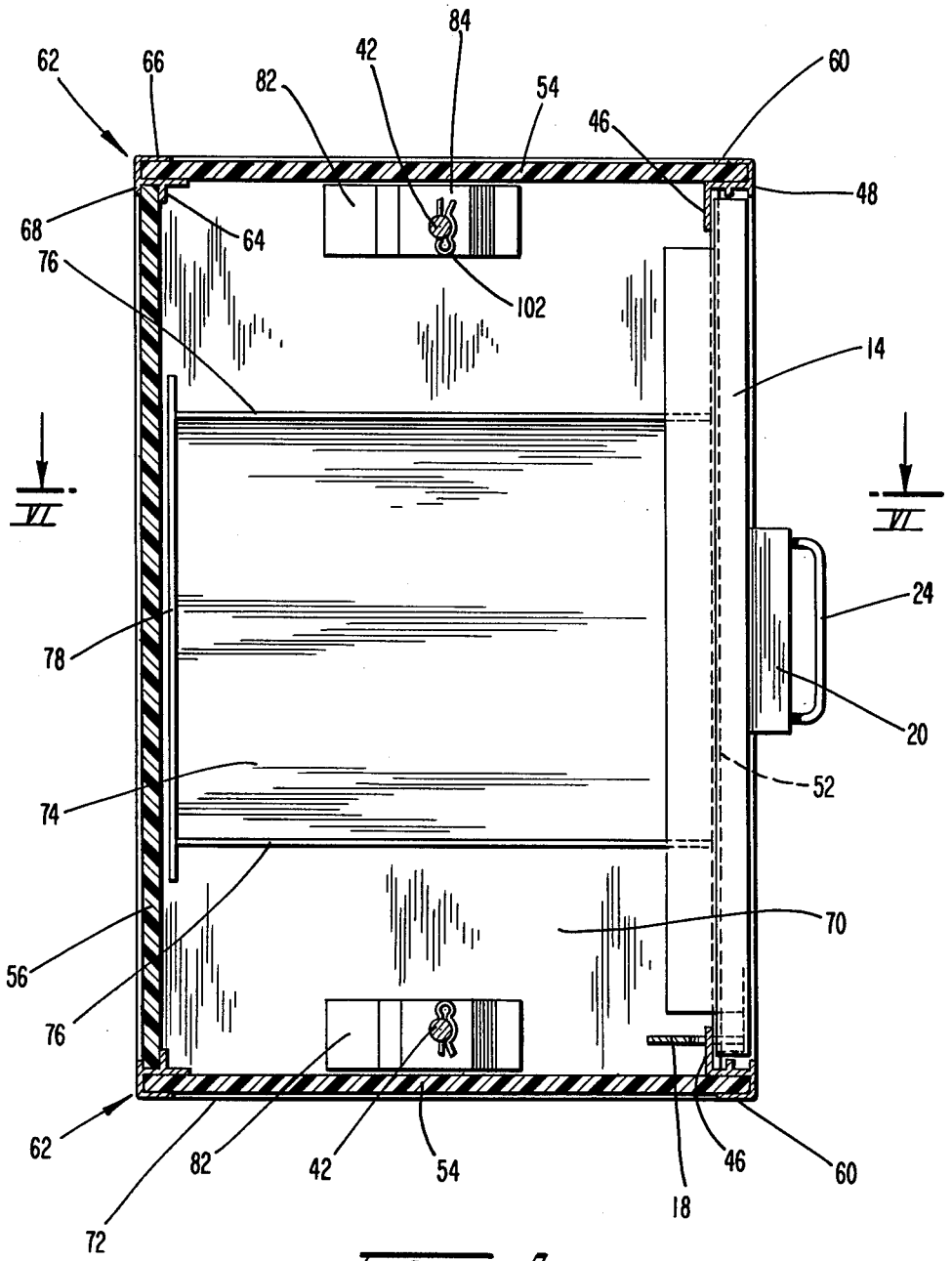
FIG. 5 is a cross-sectional bottom view of the assembled rack illustrated in FIG. 3.

Referring to FIGS. 3–5, a vending rack which embodies the principles of the present invention is illustrated in detail. The front panel 12 and door 14 are mounted to a frame comprising a pair of vertical channel members 46. The channel members can include a flange, or lip, 48 which forms a groove for accommodating the side edges of the front panel 12, as best illustrated in FIG. 3. The front panel 12 can be riveted, or otherwise fixedly attached, to the channel members, and the door 14 can be pivotally attached to the channel members, for example by means of a pin. The frame supporting the front panel 12 and the door 14 also includes two horizontal cross members 50 and 52 for added structural support. As an alternative to a pin connection for the pivotable door 14, the door could be connected to the cross member 50 by one or more hinges.

The front panel 12, door 14 and supporting frame comprising the channel members 46 and cross members 50, 52 are completely assembled at the manufacturing plant and form an integral assembly comprising one side wall panel of the rack. The three remaining side wall panels of the rack are made from three rectangular pieces of material which can be metal, for example. However, in the most preferred embodiment of the invention, the two side panels 54 and the back panel 56 (not illustrated in FIG. 3) comprise sheets of plastic. The top half of each sheet of plastic can be transparent, to provide a view of the interior of the rack to ascertain whether any newspapers are available, and the lower half of each panel can be painted a suitable color and inscribed with a logo 58 or other form of advertisement for the newspapers being vended. By way of an example, the inscribing of the advertisement can be accomplished in a relatively simple manner by a silk screening process.

As best illustrated in FIG. 5, the channel members 46 which make up the frame for the front panel each include a second curved flange, or lip, 60 which forms a groove for accommodating one of the side edges of each of the side panels 54, to thereby hold the side panels in proper position relative to the front panel. The rear panel 56 can be held in a proper position relative to the side panels by means of a pair of elongated corner assembly pieces 62. Each of the corner assembly pieces includes a right angled portion 64 and a pair of flanges 66, 68 which, together with the angled piece, form a pair of channels opening in orthogonal directions relative to one another. The channel formed between the angled piece 64 and the flange 66 accommodates the rear edge of a side panel 54, and the channel formed between the angled piece 64 and the flange 68 accommodates one of the side edges of the rear panel 56.

The top 70 of the rack is formed by a single sheet of material, preferably metal, that is turned down along each edge thereof to form a peripheral flange 72. A plate 74 can be attached to the underside of the top 70, for example by means of welding, and has the edges thereof that are parallel to the sides of the rack turned downwardly to form a pair of support ribs 76. The distance between the front of the ribs 76 and the front flange 72 of the top is just sufficient to accommodate the frame, i.e., the cross member 52, of the front panel. Thus, the ribs 76 and the front flange 72 effectively form a channel which accommodates the front panel. The rear edge of the plate 74 is also turned downwardly to form a support bracket 78. In a similar manner, the support bracket 78 and the rear flange 72 on the top 70 form a channel for accommodating the rear panel 56 of the rack. As illustrated in FIG. 3, a pair of holes 80 can be provided in the support bracket 78. A pair of matching holes can be provided in the rear panel 56 to enable a chain, for example, to be attached to the rack and looped around a light pole, tree, or the like to prevent theft of the rack once it has been installed at a desired location.

The top 70 also includes a pair of brackets 82 to which the guide rods 42 are respectively attached. Each bracket includes a depending portion 84 which provides a space between the bracket and the underside of the top. An aperture is provided in each depending portion 84, through which the top portion of a guide rod 42 is inserted. The top of each rod includes a transverse hole for accommodating a pin 86, so that once the rod is inserted into the aperture in the bracket 82 and the pin 86 is inserted in the hole, the rod cannot be removed from the bracket and is thereby coupled to the top 70 of the rack. The brackets 82 are spaced a distance from the side flanges 72 of the top 70 that is just sufficient to accommodate the side panels 54. Thus, the guide rod brackets 82, as well as the support bracket 72, prevent the side and rear panels from being pushed inwardly once the rack is assembled, to thereby inhibit removal of the panels from the exterior of the rack.

The bottom support for the rack is formed by four angled pieces 88 connected together to form a rectangular frame. An angled leg member 90 is connected to each of the corners of the frame on the exterior of the angled pieces 88. The top surface of each leg member forms a support surface on which each of the wall panels 54 and 56 rest. In addition, a lip 92 can be provided to form a channel together with the vertical portion of each angled piece 88, to thereby prevent the panel members from being pulled outwardly from the bottom thereof. An aperture 94 is provided in each of the side angle members of the bottom frame to accommodate the lower ends of the guide rods 42. In addition, apertures can be provided in each of the rear leg members 90 of the bottom piece to further facilitate chaining the rack to an immovable structure.

The front of the bottom frame formed by the angled pieces 88 is provided with a pair of upwardly protruding tongues 96 which fit into the channels provided by the channel members 46 to thereby fix the position of the front panel member relative to the bottom frame. In addition, the rear of the bottom frame can be provided with a pair of upwardly protruding pins 98 which are accommodated in rings 100, or the like, fastened to the interior of the angled pieces 64 forming the corner assembly pieces 62. Alternatively, the pins 98 can be fixedly attached to the corner assembly pieces and be inserted into holes provided on the top surface of the bottom frame, to thereby fix the position of the corner assembly pieces, and hence the side and rear panels, relative to the bottom frame.

The rack can be easily shipped in a knocked-down format, i.e., with all of the pieces being separated as illustrated in FIG. 3, and with final assembly being readily completed at the place of final destination. To assemble the rack, the top 70 is first placed on the floor in an upside-down position. The preassembled front panel including the door and the frame is inserted into the channel provided between the front flange 72 on the top and the ribs 76. If desired, the front panel can be fixedly attached to the top, for example, by means of rivets provided through the front flange and the cross member 52.

The top ends of the guide rods are then inserted in the apertures in the brackets 82, and the pins 86 are inserted in the rods to connect them to the top. The elevator shelf 38 is slid onto the rods 42, and the springs 44 are placed on their respective rods. Thereafter, the side panels 54 are placed in the channels formed between the brackets 82 and the side flanges 72 of the top, and similarly the back panel 56 is placed in the channel formed between the support bracket 78 and the rear flange of the top. The corner assembly pieces can be slid onto the side and rear panels 54, 56 so that the panels are accommodated in the channels provided in the corner assembly pieces. If desired, one or more large rubber bands can be provided with the rack to hold the side and rear panel members in place and prevent them from falling outwardly while the corner assembly pieces are being slid onto the rack.

The bottom is then positioned on the rack, with the bottom edges of the panels being accommodated in the channels formed by the lips on the bottom, and the bottom ends of the guide rods 42 protruding through the apertures 94. In addition, the tongues 96 at the front of the bottom piece will be inserted into the channels formed by the channel members 46, and the pins 98 on the rear of the bottom piece will be fitted into the rings 100 on the corner assembly pieces. A pair of nuts are then respectively threaded onto the bottom ends of the elevator rods 42 to complete the assembly of the cabinet. The guide rods thereby hold the top and bottom pieces together, clamping each of the front, side and rear panels between them in their associated channels.

The cabinet can now be turned right side up and the coin receiving box 26 attached to the top 70 of the cabinet, for example by means of bolts or the like. If desired, an additional pin 102 can be inserted in a transverse hole on each elevator rod at a desirable height to limit the upward movement of the elevator shelf 38. In addition, a pan (not shown) can be provided to be inserted in the bottom of the rack, for example to be accommodated within the central hole provided in the bottom frame. The pan can be filled with sand or other weighted material to inhibit undesired movement of the rack, for example by wind or vandals.

From the foregoing, it will be appreciated that the present invention provides a novel rack having an accessible enclosure that is particularly well suited for vending purposes and can be easily transported and stored in a knock-down condition, to thereby provide substantial savings in terms of space and transportation requirements.

The present invention may be embodied in other specific forms without departing from the spirit or essential characteristics thereof. For example, it is not limited to newspaper vending racks, but is generally applicable to any type of enclosure that is desired to be shipped or stored in a knock-down format. The presently disclosed embodiment is therefore considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. A knock-down vending rack suitable for transport in an unassembled state and adapted to be readily assembled in situ, comprising:

a rectangular top frame member having means defining a channel adjacent each of the peripheral edges thereof;

a rectangular bottom frame member having means defining a channel adjacent each of the peripheral edges thereof;

four wall panels each having a top edge and a bottom edge adapted to be received in respective channels in said top and bottom frame members;

a pair of rods each comprising a single member whose opposite ends are respectively connected to said top and bottom frame members to inhibit displacement of said frame members relative to one another and thereby clamp said wall panels in their associated channels between said frame members to define an enclosure, said rods being disposed within said enclosure when connected between said top and bottom members; and an elevator platform disposed within said enclosure and adapted for sliding movement along said rods.

2. The vending rack of claim 1 wherein one of said wall panels comprises a front wall panel having an access door therein.

3. The vending rack of claim 2 wherein said front wall panel further includes an integral frame for supporting said access door for pivotal movement relative to said panel, said frame being adapted to be fixedly connected to said top frame member when the top edge of said front wall panel is received within a channel in said top frame member.

4. The vending rack of claim 3 wherein said frame includes a pair of elongated side members defining side channels for receiving a side edge of the two adjacent side wall panels when said side wall panels are clamped between said top and bottom frame members.

5. The vending rack of claim 4 further including a pair of elongated rear corner assemblies each defining two perpendicularly disposed channels for respectively receiving side edges of the rear wall panel and an adjacent side wall panel.

6. The vending rack of claim 2 wherein the other wall panels are made of plastic.

7. The vending rack of claim 2 wherein said access door includes a latching member, and further including a coin operated latch mechanism adapted to be mounted on said top frame member for operative engagement with said latching member.

8. The vending rack of claim 1 further including springs respectively disposed on said rods for regulating the height of said elevator platform relative to said rods.

9. The vending rack of claim 1 wherein said rods are connected to said top frame member on the interior of said enclosure so as to be inaccessable from the exterior of said enclosure.

10. A knock-down vending rack suitable for transport in an unassembled state and adapted to be readily assembled in situ, comprising:

a rectangular top frame member having means defining a channel adjacent each of the peripheral edges thereof and an apertured bracket on the interior surface thereof;

a rectangular bottom frame member having means defining a channel adjacent each of the peripheral edges thereof;

four wall panels each having a top edge and a bottom edge adapted to be received in respective channels in said top and bottom frame members; and at least one rod for connection between said top and bottom frame members to inhibit displacement of said frame members relative to one another and thereby clamp said wall panels in their associated channels between said frame members to define an enclosure, said rod including a transverse hole at one end thereof for receiving a pin, so that when said end of said rod is inserted in the aperture in said bracket and a pin is placed in said hole, said rod is connected to said top frame member and is inaccessable from the exterior of said enclosure.

11. The vending rack of claim 10 wherein said top frame member includes a flange around the periphery thereof, and said apertured bracket is spaced from said flange to define one of said channels.

12. The vending rack of claim 11 wherein said rack includes two rods for connecting said frame members, and said top frame member includes two brackets spaced from the flange on opposite sides of said top frame member to define two of said channels.

13. The vending rack of claim 10 wherein the other end of said rod protrudes through an aperture in said bottom frame member and is secured to said frame member by a threaded connection.

14. The vending rack of claim 1 wherein said bottom frame member includes supporting legs, and said channels are defined by a lip in the space between two adjacent legs.

15. The vending rack of claim 1 further including a pair of elongated rear corner assemblies each defining two orthogonally disposed channels for respectively receiving side edges of the rear wall panel and an adjacent side wall panel.

16. The vending rack of claim 15 wherein said corner assemblies include pins for connecting them to said bottom frame member.

17. A knock-down vending rack suitable for transport in an unassembled state and adapted to be readily assembled in situ, comprising:

a top frame member having a pair of apertured brackets on the interior surface thereof;

a bottom frame member;

a plurality of wall panels; and a pair of rods connecting said top and bottom frame members to inhibit displacement of said frame members relative to one another and clamp said wall panels in predetermined positions between said frame members to define an enclosure, said rods being disposed within said enclosure when connected between said top and bottom frame members and each said rod including a transverse hole at one end thereof for receiving a pin, so that when said end of the rod is inserted in the aperture in an associated bracket and a pin is placed in said hole, said rod is connected to said top frame member.

18. The vending rack of claim 17 wherein the other end of each rod protrudes through an aperture in said bottom frame member and is secured to said frame member by a threaded connection.

* * * * *